US007493861B1

(12) United States Patent
Walters

(10) Patent No.: US 7,493,861 B1
(45) Date of Patent: Feb. 24, 2009

(54) TANDEM SHAPED CHARGE WARHEAD HAVING A CONFINED FORWARD CHARGE AND A LIGHT-WEIGHT BLAST SHIELD

(75) Inventor: William P. Walters, Elkton, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 07/386,800

(22) Filed: Jul. 24, 1989

(51) Int. Cl.
*F42B 12/18* (2006.01)

(52) U.S. Cl. ..... 102/476; 102/308; 102/310

(58) Field of Classification Search ..... 102/307, 102/308, 310, 275.3, 476
See application file for complete search history.

(56) References Cited

U.S. PATENT DOCUMENTS

| | | | | |
|---|---|---|---|---|
| 3,750,582 A | | 8/1973 | Kintish et al. | 102/56 |
| 4,004,515 A | | 1/1977 | Mallory et al. | 102/24 |
| 4,606,272 A | * | 8/1986 | Kerdraon | 102/308 |
| 4,667,598 A | * | 5/1987 | Grobler et al. | 102/215 |
| 4,714,022 A | * | 12/1987 | Chaumeau et al. | 102/308 |
| 4,724,767 A | * | 2/1988 | Aseltine | 102/307 |
| 4,841,864 A | * | 6/1989 | Grace | 102/307 |
| 4,860,654 A | * | 8/1989 | Chawla et al. | 102/310 X |
| 4,862,804 A | * | 9/1989 | Chawla et al. | 102/309 |

FOREIGN PATENT DOCUMENTS

| | | | | |
|---|---|---|---|---|
| DE | 2306889 | * | 2/1973 | 102/308 |

OTHER PUBLICATIONS

W. M. Evans "The Hollow Charge Effect" Mar. 1950.
Ake Persson "A Theoretical Analysis of the Mechanics of Tandem Shaped Charges and Their Interraction With Different Targets" Mar. 1984.

* cited by examiner

*Primary Examiner*—Michael Carone
(74) *Attorney, Agent, or Firm*—Lawrence E. Anderson; Richard A. Morgan; Saul Elbaum

(57) ABSTRACT

A tandem shaped charge warhead having a forward charge and a rear charge mounted in tandem along a charge axis. The forward charge has a shaped charge liner with an explosive surrounding it, along with a metallic confinement housing surrounding the explosive and liner, with a retaining ring at the front to secure the liner to the confinement housing. The confinement housing has a cavity between the explosive and its' exterior surface which houses a booster and detonator. The rear charge is a conventional shaped charge warhead with a conical liner. A delay timing means is provided for imparting an activation delay in the detonations of the charges from the forward to the rear charge. In one embodiment, a light-weight blast shield is placed between the forward and the rear charge. The tandem system is capable of time delays which exceed the state-of-the-art by more than factor of four.

6 Claims, 2 Drawing Sheets

TANDEM SHAPED CHARGE WARHEAD HAVING A CONFINED FORWARD CHARGE AND A LIGHT-WEIGHT BLAST SHIELD

RIGHTS OF THE GOVERNMENT

The invention described herein may be manufactured, used and licensed by or for the United States Government for Governmental purpose without payment to us of any royalty thereon.

BACKGROUND OF THE INVENTION

The present invention is related to explosive devices, especially those of a military nature, and is more particularly directed to a unique method for combining the blast shield with the forward charge in a tandem warhead system requiring a very long time delay between firing of the forward and rear charges.

The short time delay (less than 500 micro-seconds) tandem shaped charge warhead is well known in the prior art. Examples are U.S. Pat. Nos. 3,750,582 and 4,714,022. The techniques used in these inventions involve a forward charge followed by a blast shield which is in turn followed by a rear charge. In these devices the tandem warhead attacks military targets such as tanks as follows: the forward charge fires first and disrupts the outer armor of the target by causing reactive armor plates to initiate, by fracturing the laminate material in laminate (e.g., glass) armors, or by causing plate motion in bulging plate or (e.g. Chobham) armors. After a very short time delay, generally less than 500 microseconds, the rear charge fires and penetrates the remaining armor of the target and causes lethal damage to the occupants or interior components. During the time interval between the firing of the forward charge and the firing of the rear charge, the rear charge and its associated time delay system is protected from damage and/or premature detonation by a blast shield between the charges. As the time delay between the firing of the forward charge and the rear charge is increased (to 2000 microseconds and beyond), the blast shield must be made quite massive in order to protect the rearward components during the detonation of the high explosive of the forward charge, i.e. as the time delay is increased, so must the mass of the blast shield be increased in order to protect the rear charge from increased blast fragments and detonation products of the forward charge. The blast shield and the time delay must also be adjusted such that the blast shield remains out of the region required for jet formation of the rear charge. Thus, the rearward movement of the blast shield (caused by the explosive force of the forward charge) must be of relatively slow velocity, dependent not only upon the separation distance available between the rear charge and the blast shield but also the time delay required. The prior art generally slowed down the blast shield velocity by increasing its mass. This method resulted in a relatively heavy tandem warhead where long time delays (greater than 2000 microseconds) were necessary.

OBJECTS AND SUMMARY OF THE INVENTION

It is therefore a primary object of the invention to reduce the size and weight of the blast shield by combining the blast shield with the forward charge thus eliminating the blast shield entirely or replacing it with a thin lightweight blast shield to protect the rear charge from fragments or detonation products of the forward charge in long time delay tandem warhead systems.

Another object of the invention is to reduce the amount of explosive surrounding the forward charge thus reducing the possibility of damage to the rear charge.

A further object of the invention is to reduce the weight of the warhead and the distance between the rear of the forward charge and the face of the rear charge, thus reducing the total weight and size of the projectile into which the warhead is placed.

In the present invention, the forward shaped charge liner remains essentially unaltered but the amount of explosive surrounding the forward shaped charge liner is greatly reduced. This reduction in the amount (or weight) of explosive surrounding the liner is compensated for by confining the forward charge with a thick metal casing. This confinement of the forward charge acts to keep the pressure high enough to allow the shaped charge liner to collapse in the normal manner. Using this technique, the explosive weight can be reduced 50 to 75 percent, which greatly reduces the possibility of interference with to the rear charge. The total warhead length can also be reduced by 20 to 40 percent and the overall warhead weight can be reduced by 10 to 30 percent. The forward charge confinement thickness is greater, and the explosive weight of the forward charge is less, than that used in any known warhead design. By proper selection and balance between the mass of the forward shaped charge explosive and the mass of the explosive confinement, successful and even enhanced collapse of the forward shaped charge liner is assured.

DETAILED DESCRIPTION OF THE PREFERRED EMBODIMENTS

Figure 1:
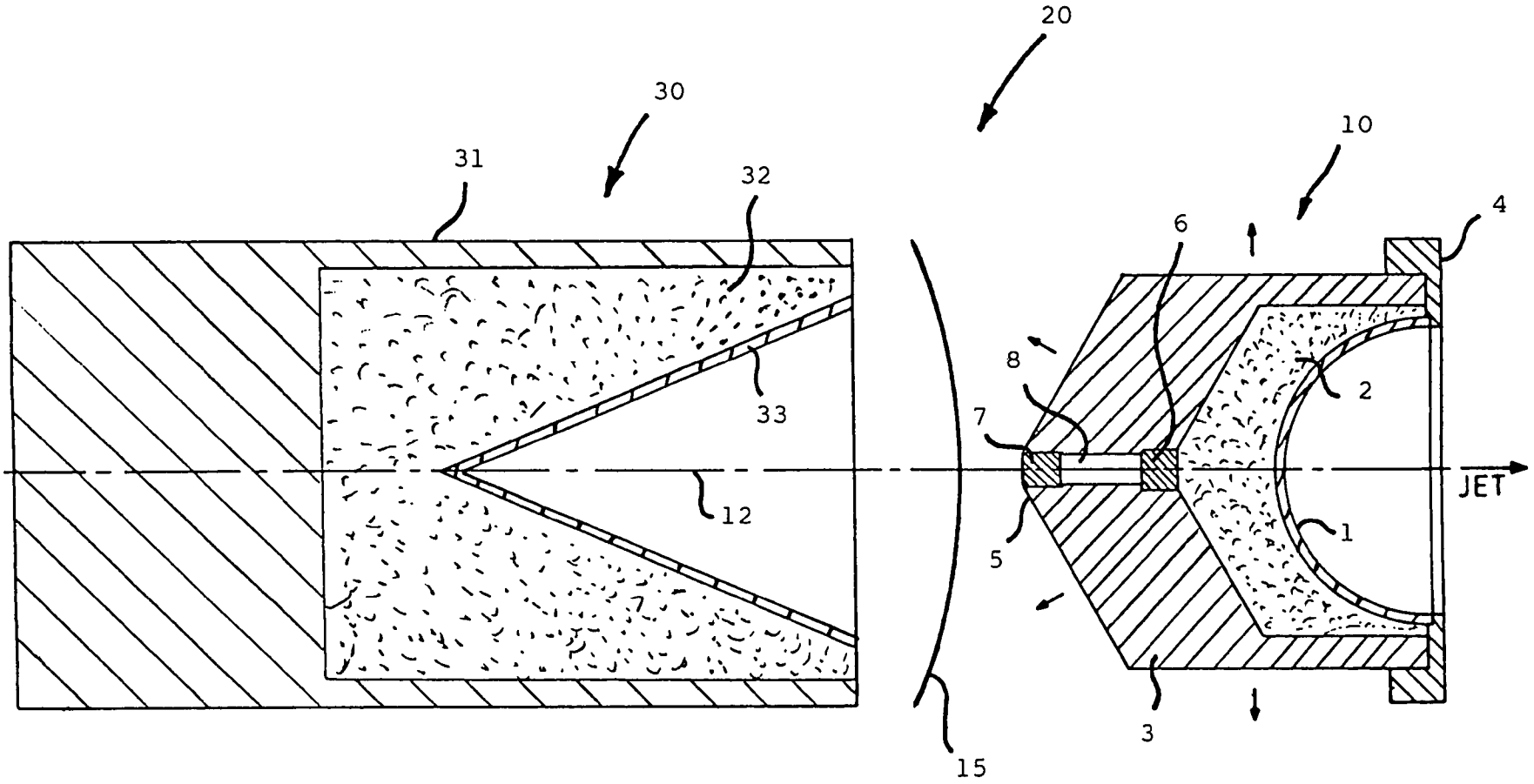
FIG. 1 is a cross section of a tandem shaped charge warhead having a confined forward charge, a lightweight blast shield and a rear charge.

Referring now to FIG. 1, a tandem shaped charge warhead having a confined forward charge, a lightweight blast shield, and a rear charge is shown generally by the numeral 20. In this embodiment, a hemispherical shaped charge liner 1 is shown as a representative shaped charge liner in forward charge 10. Liner 1 need not be hemispherical in shape but could also be conical, elliptical, parabolic or have any arcuate shape. Liner 1 material can be any material suitable for shaped charge application as specified by the prior art, e.g. Cu, Al, Zn, Ta, W, Mo, Pb, Steel, Fe, Du, etc. High-explosive 2 surrounds liner 1, as in a conventional shaped charge warhead, but is confined by a cylindrical confinement housing 3. Retaining ring 4 is a ring surrounding the front of explosive 2 and is attached to confinement housing 3 by screws, bolts or any other suitable arrangement. Retaining ring 4 is necessary to hold liner 1 in place prior to detonation of high explosive 2 and to prevent the explosive detonation products from rapidly exiting near the equator of liner 1. A hole is provided in end 5 of confinement housing 3 to accommodate booster 6 and detonator 7, and also allowing confinement housing 3 to act as a centering device for forward charge 10. The diameter of the hole for detonator 7 is larger than the diameter of cavity 8 to aid in the assembly of forward charge 10 and to provide additional volume to insulate detonator 7 lead wires from the electrically conducting confinement housing 3. In a similar manner, the diameter of the hole provided for booster 6 is larger than cavity 8. Located behind forward charge 10 and along charge axis 12 is rear charge 30, a conventional high-explosive, high-performance hollow shaped charge and includes a conical liner 33, a mass of high-explosive 32 and a cylindrical housing 31. A lightweight blast shield 15, located between forward charge 10 and rear charge 30, is used in those instances where rear charge 30 needs extra protection from the blast fragments of forward charge 10. Not shown in FIG. 1 is the casing or missile body in which forward charge 10, blast shield 15 and rear charge 30 is contained. The design of the casing, however, is well known in the prior art. Also not shown is the delay timing mechanism and the safe-arm-initiation mechanism of the rear charge; the design of these items is also well known in the prior art.

A unique method must be employed in assembling forward charge 10. A cast explosive, such as OCTOL (a composition consisting of 75% HMX and 25% TNT) is poured over liner 1. For safety reasons, booster 6 and detonator 7 are inserted into confinement housing 3 just before final assembly of warhead 20. Because of the physical constraints of housing 3, explosive 2 must first be cast over liner 1 in a dummy confinement tube. The dummy confinement tube is then removed and booster 6 is inserted into confinement housing 3. Next, liner 1 and explosive 2 are inserted into confinement housing 3 and retaining ring 4 is attached. Finally, detonator 7 is inserted into housing 3, completing the assembly. This method of assembly is necessary because cavity 8 is too small to assure a uniform, homogeneous explosive fill if explosive 2 were poured through cavity 8 into the cavity behind liner 1. Also, booster 6 cannot be inserted into its position through cavity 8 because the diameter of cavity 8 is smaller than the diameter of booster 6. The diameter of cavity 8 is smaller than the diameter of booster 6 to assure accurate detonator/booster alignment and, hence, a precision initiation. Cavity 8 cannot be larger than booster 6 or detonator 7 because a larger cavity 8 would reduce the mass of confinement housing 8 and would also allow a larger volume of detonation products to escape through cavity 8 and be directed toward rear charge 30. Pressed explosives such as LX-14 may also be used. In this case the explosive billit is machined to fit into the confinement cavity and a cavity is machined in the explosive to accept the shaped charge liner. However, upon initiation of explosive 2, some confinement housing 3 materials and/or explosive 2 products may escape through cavity 8 and fly toward rear charge 30, a thin low mass blast shield 15, designed to deflect this material, may be necessary in certain embodiments of this invention.

Figure 2:
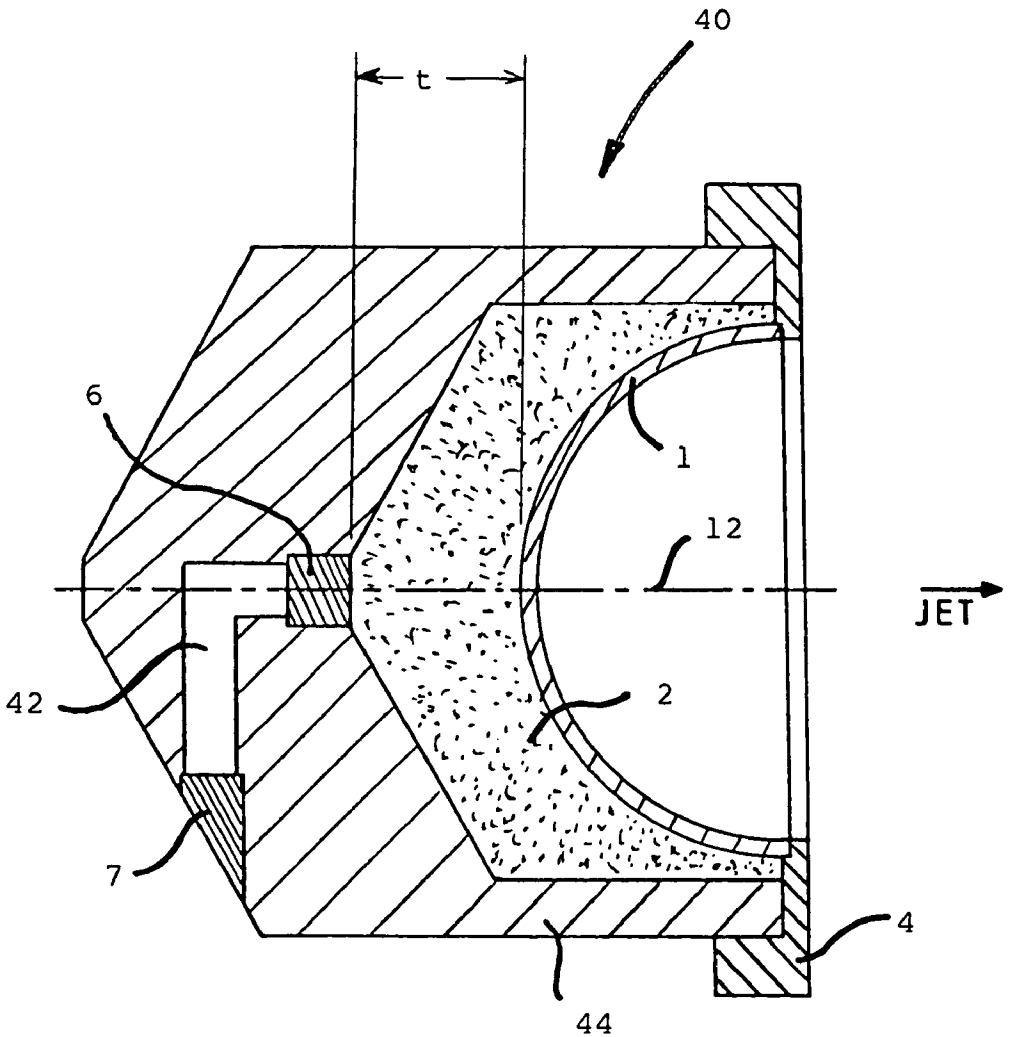
FIG. 2 is a cross section of an alternate embodiment of a forward charge having a confined liner and explosive charge.

Shown in FIG. 2 is an alternative embodiment of a forward charge 40 having a confined liner and explosive charge. Instead of aligning the cavity between the booster and the detonator along the charge axis-of-symmetry 12 (as shown in FIG. 1), cavity 42 between booster 6 and detonator 7 is provided with a 90° turn. This design helps to keep escaping detonation products away from a direct line of approach to rear charge 30. Cavity 42 serves the same function as cavity 8 of FIG. 1 and is essentially the same size. Confinement housing 44 is constructed in the same manner as confinement housing 3 of FIG. 1, except for the 90° turn in cavity 42. Liner 1, explosive 2 and retaining ring 4 are identical to those shown in FIG. 1.

An example of a forward charge fabricated according to the teachings of this invention as shown in FIG. 1 had a copper hemispherical liner 1 that was 1.9 mm thick with a 76.2 mm outside diameter. High explosive 2 was 75/25 OCTOL and had a maximum head height "t" (as depicted in FIG. 2) of 25.4 mm. The diameter of confinement housing 3 was 100 mm and the outside diameter of retaining ring 4 was 118 mm. The diameter of the hole for booster 6 was 10 mm and for detonator 7 was 9 mm. Each hole was 10 mm deep. The same shaped charge warhead fired in a point-initiated conventional mode (without confinement) would have had a maximum explosive head height "t" of 76 mm. Confinement housing 3 was made from lead, used because of its high density and because of its low melting temperature which tends to vaporize upon initiation of explosive 2. Additionally, a soft material, such as lead, can be more easily penetrated by the jet from rear charge 30 than a stronger material such as steel. Other materials may be used for confinement housing 3, such as steel, aluminum, or any other known metal or alloy. The main requirement of the material used to fabricate confinement housing 3 or 44 is that it add sufficient mass to maintain the required pressures to successfully collapse the forward shaped charge liner 1.

A distinct advantage of the present invention over the prior art is that following detonation of high explosive 2, the majority of the confinement housing 3 or 44 material will move laterally away from the charge axis-of-symmetry 12 and will not be directed parallel to charge axis 12 and thus towards rear charge 30. FIG. 1 shows four arrows indicating the direction of travel of the confinement housing material after initiation of explosive charge 2.

Tests of a forward charge having a confined liner and explosive charge as shown in FIG. 1 were conducted using a tetryl booster 6 and a ND211 detonator 7. The weight of explosive 2 was 340 grams and the weight of confinement housing 3 (made from lead) was from 4680 to 4718 grams. Test results indicated that the shaped charge jet of forward charge 10 moved faster than predicted, e.g., the jet tip velocity was greater than 5.5 km/sec. A standard (unconfined), point-initiated charge with a one charge diameter (89 mm) head height would generally have a tip velocity of about 4.5 km/sec. This indicates that the explosive weight and hence, the confinement housing 3 weight could have been reduced further. Further reduction of the high explosive weight and/or the confinement weight would return the shaped charge jet characteristics to their conventional wall. The velocity of the fragments of lead confinement housing 3 was 0.3 km/sec which agreed with the calculated values using both hydrocodes and explosive-metal interaction formulas. Also, vaporization of the lead housing was evident from these experimental tests.

In general, heavily confined shaped charges are not used in practice. Such charges are not weight efficient and in fact excessive metal confinement can disrupt the collapse of the shaped charge liner. Also, the use of confinement weight and diameter is usually inefficient in that the extra weight and diameter allowed in a fined charge can be better utilized as high explosive or liner material. In fact bare, e.g., non-confined, charges can perform as well as confined charges.

General design rules contend that the maximum confinement thickness be less than or equal to 0.1 of the charge diameter (CD). Confinement thicknesses above 0.1 CD provide no additional enhancement of the shaped charge jet (in fact severe confinement ratios may disrupt the jet collapse). In the present invention, the confinement thickness os 0.13 to 0.4 charge diameters. The confinement thickness, the explosive thickness and the liner thickness are all adjusted to provide a quality (i.e. not overdriven) jet from the shaped charge liner. In a typical application, the total high explosive to confinement weight ratio is between 0.06 and 1.0. At the plane of the base or equator of the shaped charge, the ratio of high explosive thickness to confinement thickness is between 0.1 and 2.0 depending on the liner thickness.

In addition, the confinement geometry need not be cylindrical as shown in FIGS. 1 and 2. This geometry was selected for ease of fabrication. The confinement geometry may be similar to the liner geometry, i.e., a hemispherical shaped confinement with a hemispherical liner, a conical confinement with a conical liner, etc.

To those skilled in the art, many modifications and variations of the present invention are possible in light of the above teachings. It is therefore to be understood that the present invention can be practiced otherwise than as specifically described herein and still will be within the spirit and scope of the appended claims.

I claim:

1. A tandem shaped charge warhead comprising:

a forward charge and a rear charge disposed in tandem along a charge axis;

said forward charge comprising a shaped charge liner, an explosive charge surrounding said liner on the concave side, a metallic confinement housing surrounding said explosive charge and said liner, and a retaining ring fixedly attached to said confinement housing so as to secure said liner;

said confinement housing having a cavity disposed between said explosive and the exterior surface of said confinement housing, said cavity having a booster disposed at the end of said cavity open to said explosive, and a detonator disposed at the end of said cavity open at the exterior surface of said housing, said cavity containing a 90° turn;

said rear charge comprising a shaped charge liner, an explosive surrounding said liner, a cylindrical housing surrounding said explosive and liner and a safe-arm-initiation mechanism;

means for mounting said forward and said rear charges in tandem;

a delay timing means for imparting an activation delay in the detonations of said charges from the forward to the rear charge.

2. A tandem shaped charge warhead comprising:

a forward charge and a rear charge disposed in tandem along a charge axis;

said forward charge comprising a hemispherical shaped charge liner made from copper having a thickness of 1.9 mm and an outside diameter of 76.2 mm, and explosive charge consisting of 340 grams OCTOL surrounding said liner, a cylindrical confinement housing made from 4680 grams of lead surrounding said explosive charge and said liner, and a retaining ring fixedly attached to said confinement housing so as to secure said liner;

said cylindrical confinement housing having a cavity disposed between said explosive and the exterior of said housing, said cavity having a tetryl booster disposed in the end of said cavity open to said explosive, and a ND211 detonator disposed at the end of said cavity open at the exterior surface of said housing;

said rear charge comprising a conical shaped charge liner, an explosive surrounding said liner, a cylindrical housing surrounding said explosive and liner and a safe-arm-initiation mechanism;

means for mounting said forward and said rear charges in tandem;

a delay timing means for imparting an activation delay in the detonations of said charges from the forward to the rear charge.

3. The device of claim 2 wherein said activation delay is greater than 2000 microseconds.

4. The device of claim 2 further comprising a lightweight blast shield disposed between said forward charge and said rear charge.

5. The device of claim 2 wherein said cavity disposed between said explosive and the exterior surface of said housing contains a 90° turn.

6. A tandem shaped charge warhead comprising:

a forward charge and a rear charge disposed in tandem along a charge axis;

said forward charge comprising a shaped charge liner, an explosive charge surrounding said liner on the concave side, a metallic confinement housing surrounding said explosive charge and said liner, and a retaining ring fixedly attached to said confinement housing so as to secure said liner;

said confinement housing having a cavity disposed between said explosive and the exterior surface of said confinement housing and having a 90° turn therein, said cavity having a booster disposed at the end of said cavity open to said explosive, and a detonator disposed at the end of said cavity open at the exterior surface of said housing;

said rear charge comprising a shaped charge liner, an explosive surrounding said liner, a cylindrical housing surrounding said explosive and liner and a safe-arm-initiation mechanism;

means for mounting said forward and said rear charges in tandem;

a delay timing means for imparting an activation delay of 2000 microseconds or greater in the detonations of said charges from the forward to the rear charge.

* * * * *